US005355681A

United States Patent [19]

Xu

[11] Patent Number: 5,355,681

[45] Date of Patent: Oct. 18, 1994

[54] AIR SEPARATION SCHEMES FOR OXYGEN AND NITROGEN COPRODUCTION AS GAS AND/OR LIQUID PRODUCTS

[75] Inventor: Jianguo Xu, Fogelsville, Pa.

[73] Assignee: Air Products and Chemicals, Inc., Allentown, Pa.

[21] Appl. No.: 126,156

[22] Filed: Sep. 23, 1993

[51] Int. Cl.[5] ..... F25J 3/02

[52] U.S. Cl. ..... 62/25; 62/38; 62/41

[58] Field of Search ..... 62/25, 38, 41

[56] References Cited

U.S. PATENT DOCUMENTS

| | | | |
|---|---|---|---|
| 3,426,543 | 2/1969 | Becker | 62/41 |
| 3,605,422 | 9/1971 | Pryor et al. | 62/13 |
| 4,006,001 | 2/1977 | Schonpflug | 62/41 |
| 4,152,130 | 5/1979 | Theobald | 62/18 |
| 4,717,410 | 5/1988 | Grenier | 62/29 |
| 5,098,457 | 3/1992 | Cheung et al. | 62/24 |
| 5,165,245 | 11/1992 | Agrawal et al. | 62/38 |

*Primary Examiner*—Ronald C. Capossela

*Attorney, Agent, or Firm*—Willard Jones, II; William F. Marsh; James C. Simmons

[57] ABSTRACT

The present invention is an improvement to a cryogenic distillation process for the separation of air into its constituent components. The present invention process uses a distillation column system which comprises at least two distillation columns wherein the top of the higher pressure column is in thermal communication with the lower pressure column. The distinctive feature and improvement of the present invention comprise: (a) condensing a portion of the compressed, contaminant-free, feed air by appropriate means, such as against vaporization of liquid oxygen or other source of refrigeration; (b) using at least a portion of this liquid air as impure reflux in one of the distillation columns, and (c) removing a waste vapor stream from a location situated no more than four theoretical stages above the location where the liquid air is fed to the column, such that this waste vapor stream has a nitrogen mole fraction of less than 0.95.

7 Claims, 7 Drawing Sheets

AIR SEPARATION SCHEMES FOR OXYGEN AND NITROGEN COPRODUCTION AS GAS AND/OR LIQUID PRODUCTS

TECHNICAL FIELD OF THE INVENTION

The present invention relates to a process for the production of nitrogen and oxygen by the cryogenic distillation of air.

BACKGROUND OF THE INVENTION

The most commonly used and most well known air separation process for oxygen production is the Linde double column cycle invented in the first half of the century. The basic concept of the Linde double column cycle is to have thermal communication between the top of the higher pressure column and the bottom of the lower pressure column to condense the vapor nitrogen from the higher pressure column and reboil the liquid oxygen in the bottom of the lower pressure column. A portion of the liquid nitrogen that is taken out of the higher pressure column is then sent to the top of the lower pressure column as the reflux. Such an air separation plant can recover more than 90% of the oxygen in the feed air, so that vapor coming out of the lower pressure contains more than 97% nitrogen. In cases in which large quantities of nitrogen is demanded as co-product, and the nitrogen has to meet a certain purity requirement, a waste stream is taken out a few trays below the top of the lower pressure column in order to control the nitrogen product purity. Such waste streams, however, are still designed to contain more than 95% nitrogen so that the recovery of oxygen, and that of argon can be kept high. Flow of such a waste stream is also usually limited to below 15%, which is enough for regeneration of the mole sieve adsorption bed using thermal swing adsorption-desorption technique.

When liquid is also produced in substantial quantities, the conventional method is to introduce a refrigeration system in which nitrogen is used as the working fluid. This system produces liquid nitrogen which is used as product and/or additional reflux for the air separation unit which, still keeps the Linde double column with characteristics described above, such as can be seen in U.S. Pat. No. 3,605,422. When the liquid/feed ratio is relatively small, a refrigeration system in which air is used as the working fluid can be used. Such a liquefier uses the refrigeration from expansion of a portion of the high pressure air to condense another portion of high pressure air. The air separation unit, however, is still the Linde double column cycle with characteristics described before, such as is shown by U.S. Pat. No. 4,152,130.

Since the above mentioned processes all use the conventional Linde double column cycle, which achieves an essentially complete separation of air into oxygen and nitrogen (and argon in some applications), they are appropriate if almost all of the products of air separation, i.e. oxygen and nitrogen (and argon) are required. In many cases, however, a large portion of the nitrogen produced from an air separation plant cannot find use (other than for chilling water in a waste tower). Accordingly, some of the product nitrogen is vented to atmosphere after it exits the cold box. In other cases, some of the product gas is demanded as liquid products. In either of these cases, better cycles can be used to reduce the power consumption as well as capital cost of the air separation unit.

U.S. Pat. No. 5,165,245 discloses a process with an elevated pressure double column system. In the process, refrigeration from expansion of the high pressure nitrogen is used to produce liquid products. The benefits of such elevated pressure processes include reduced pressure drop loss and reduced sized process equipment, e.g., pipes and heat exchangers. Unfortunately, if no liquid products are produced or needed, then such a process is not suitable.

SUMMARY OF THE INVENTION

The process of the present invention relates to an improvement to a cryogenic distillation process for the separation of compressed, dry and contaminant-free air into its constituent components utilizing a distillation column system having at least two distillation columns operating at different pressures, wherein the top of the higher pressure column is in thermal communication with the lower pressure column, wherein a nitrogen product is produced at the top of the higher pressure column and an oxygen product is produced at the bottom of the lower pressure column. The improvement is characterized in that: (a) a portion of the compressed, dry and contaminant-free feed air is condensed thereby producing a liquid air stream; (b) feeding at least a portion of the liquid air stream as impure reflux to at least one distillation column of the distillation column system, and (c) removing a waste vapor stream having a nitrogen mole fraction of less than 0.95 from a location in the distillation column system situated not more than four theoretical stages above the location in the column where the liquid air stream of step (b) is fed to the distillation column system, In its preferred modes, the liquid air stream portion of step (b) is fed to the top of the lower pressure column and the waste vapor stream of step (c) is removed from the top of the lower pressure column. Also, another portion of the liquid air of step (a) can be fed to an intermediate location of the higher pressure column and another waste vapor stream can be removed from a location of the high pressure column not more than four theoretical stages above the location in the column where the another portion of liquid air is fed to the higher distillation column.

Further, the portion of feed air of step (a) can be condensed by heat exchange with warming process stream leaving the process or by heat exchange with boiling liquid oxygen in the bottom the lower pressure column or by both heat exchanges.

DETAILED DESCRIPTION OF THE INVENTION

The present invention is an improvement to a cryogenic distillation process for the separation of air into its constituent components. The present invention process uses a distillation column system which comprises at least two distillation columns wherein the top of the higher pressure column is in thermal communication with the lower pressure column. The distinctive feature and improvement of the present invention comprise: (a) condensing a portion of the compressed, contaminant-free, feed air by appropriate means, such as against vaporization of liquid oxygen or other source of refrigeration; (b) using at least a portion of this liquid air as impure reflux in one of the distillation columns, and (c) removing a waste vapor stream from a location situated no more than four theoretical stages above the location where the liquid air is fed to the column, such that this waste vapor stream has a nitrogen mole fraction of less than 0.95. To better understand the present invention, several specific embodiments of the present invention will now be discussed.

Figure 1:
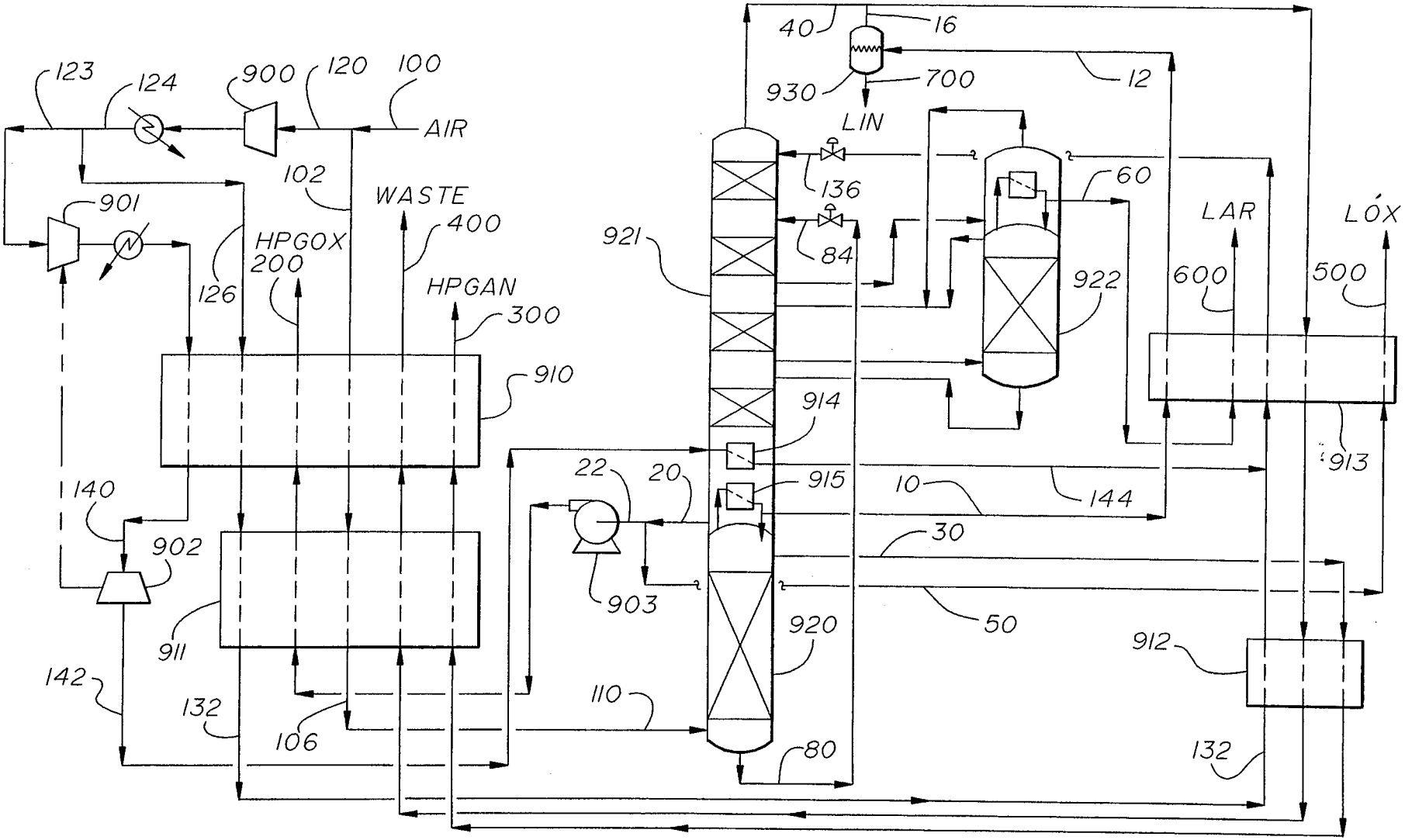
FIGS. 1 through 4 are schematic diagrams of several embodiments of the process of the present invention.

FIG. 1 illustrates and embodiment which is suitable for producing oxygen at elevated pressure, nitrogen at elevated pressure, as well as liquid argon and some (less than 10% of feed air) liquid oxygen and liquid nitrogen. In this embodiment, the compressed and dry, contaminant-free air stream, line 100, is first split into two portions, lines 102 and 120. The first portion, line 102, is cooled in main heat exchangers 910 and 911 to a temperature close to its dew point and then fed, via line 110, to the base of higher pressure column 920. The second portion, line 120, is further compressed in compressor 900 to a higher pressure and this higher pressure air, line 124, is then further split into two substreams, lines 126 and 123. The first substream, line 126, is cooled and condensed in main heat exchangers 910 and 911 thereby producing liquid air, line 132, which is further subcooled in warmer subcooler 912, combined with liquid air condensed in the base of lower pressure column 921, line 144, further cooled in colder subcooler 913, reduced in pressure and then fed, via line 136, to the top of lower pressure column 921. The other substream, line 123, is compressed in compressor 901 and cooled in the upper portion of main heat exchanger 910 and expanded to an appropriate pressure in expander 902; in the present embodiment, compressor 901 and expander 902 are mechanically linked. The expander effluent, line 142, is condensed in boiler/condenser 914 located at the bottom of lower pressure column 921, by heat exchange against vaporizing liquid oxygen. The liquid air thus obtained, line 144, is combined with the liquid air coming from warmer subcooler 912.

In higher pressure column 920, the feed air, line 110, is distilled into a higher pressure nitrogen overhead and an oxygen-enriched bottoms liquid. A portion of the nitrogen overhead is removed as a gaseous nitrogen stream, line 30, warmed to recover refrigeration in heat exchangers 912, 911 and 910 and recovered as the high pressure gaseous nitrogen product (HPGAN), line 300. The remaining portion of the higher pressure nitrogen overhead is condensed in reboiler/condenser 915 located in the bottom of low pressure column 921. A fraction of the condensed nitrogen is returned to the top of higher pressure column 920 as reflux and another fraction, line 10, is subcooled in colder subcooler 913, flashed and phase separated in separator 930. The liquid portion is removed as liquid nitrogen product, via line 700. The vapor portion, line 16, is combined with waste nitrogen, line 40, warmed to recover refrigeration in heat exchangers 913, 912, 911 and 910, and vented as waste, line 400. The oxygen-enriched bottoms liquid, line 80, is removed, reduced in pressure, and fed, via line 84, to an intermediate location of low pressure column 921.

The feed streams to lower pressure column 921 are distilled to produce a waste nitrogen, line 40, and a liquid oxygen bottoms. The waste nitrogen, line 40, which contains less than 95% nitrogen, is mixed with the nitrogen vapor, line 16, from phase separator 930. The liquid oxygen bottoms is removed, via line 20, is split into two portions, line 22 and 50. A first portion, line 50, is subcooled in colder subcooler 913 and removed as liquid oxygen product, via line 500. The other portion, line 22, is pumped in pump 903 to a suitable pressure, heated and vaporized in main heat exchangers 911 and 910, and removed as high pressure gaseous oxygen product (HPGOX), line 200.

In this embodiment, a side column for producing argon is also shown. This side arm column 922 which removes vapor feed from lower pressure column 921 at a location above the bottom section of the lower pressure column and returns the oxygen-rich liquid from side arm column 922 to the same location. Condenser duty for side arm column 922 is provided by intermediate liquid descending the lower pressure column. A liquid argon stream, line 60, is removed and subcooled in colder subcooler 913 before being removed as liquid argon product, line 600.

Figure 2:
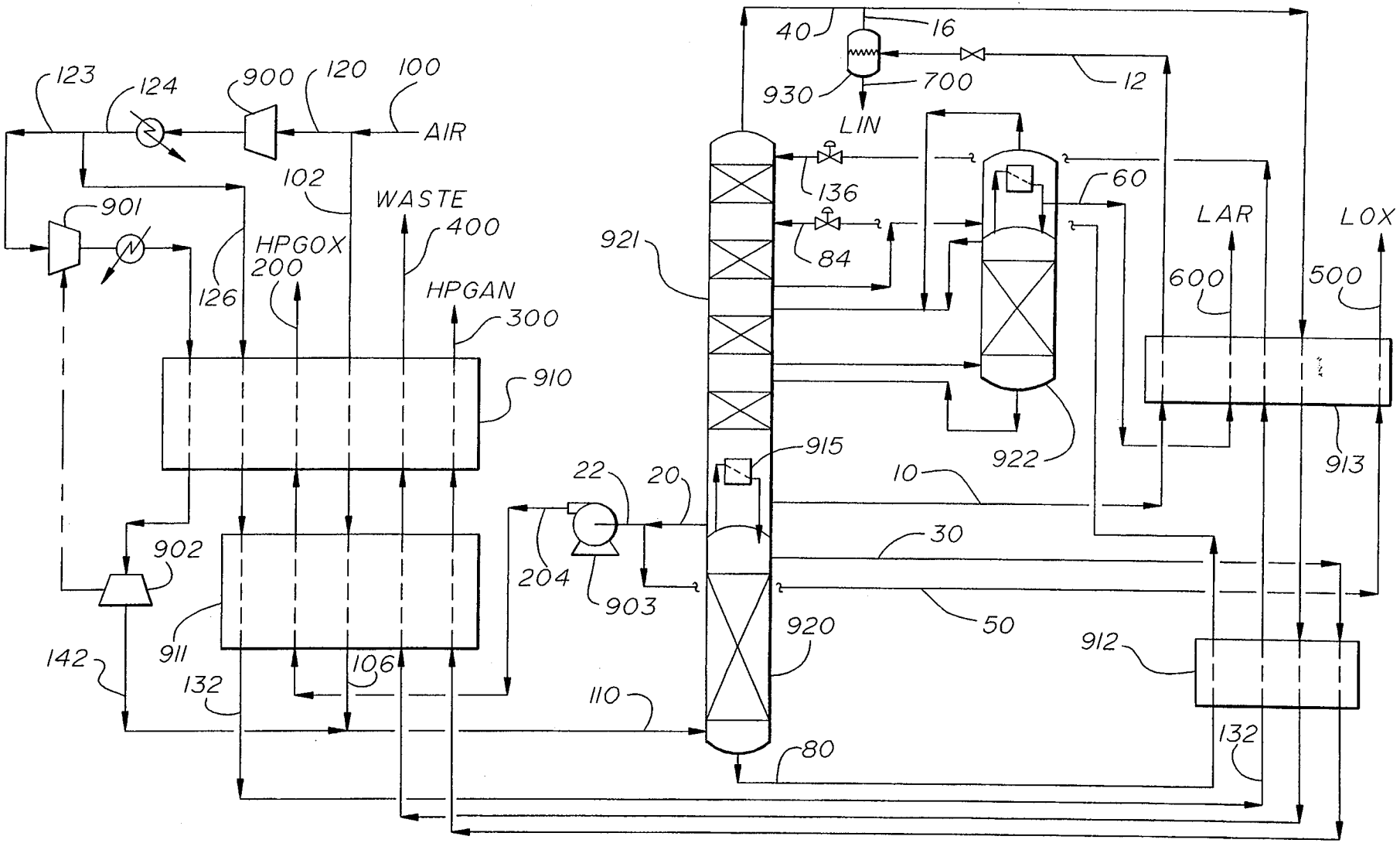

It is helpful to note that when higher quantities of pressurized nitrogen are required, the expander effluent, line 142, can be combined with the cooled feed air, line 106, and fed directly to the bottom of higher pressure column 920. This option is illustrated in FIG. 2. Except for the above change, the remainder of the embodiment shown in FIG. 2 is the same as that shown in FIG. 1.

Figure 3:
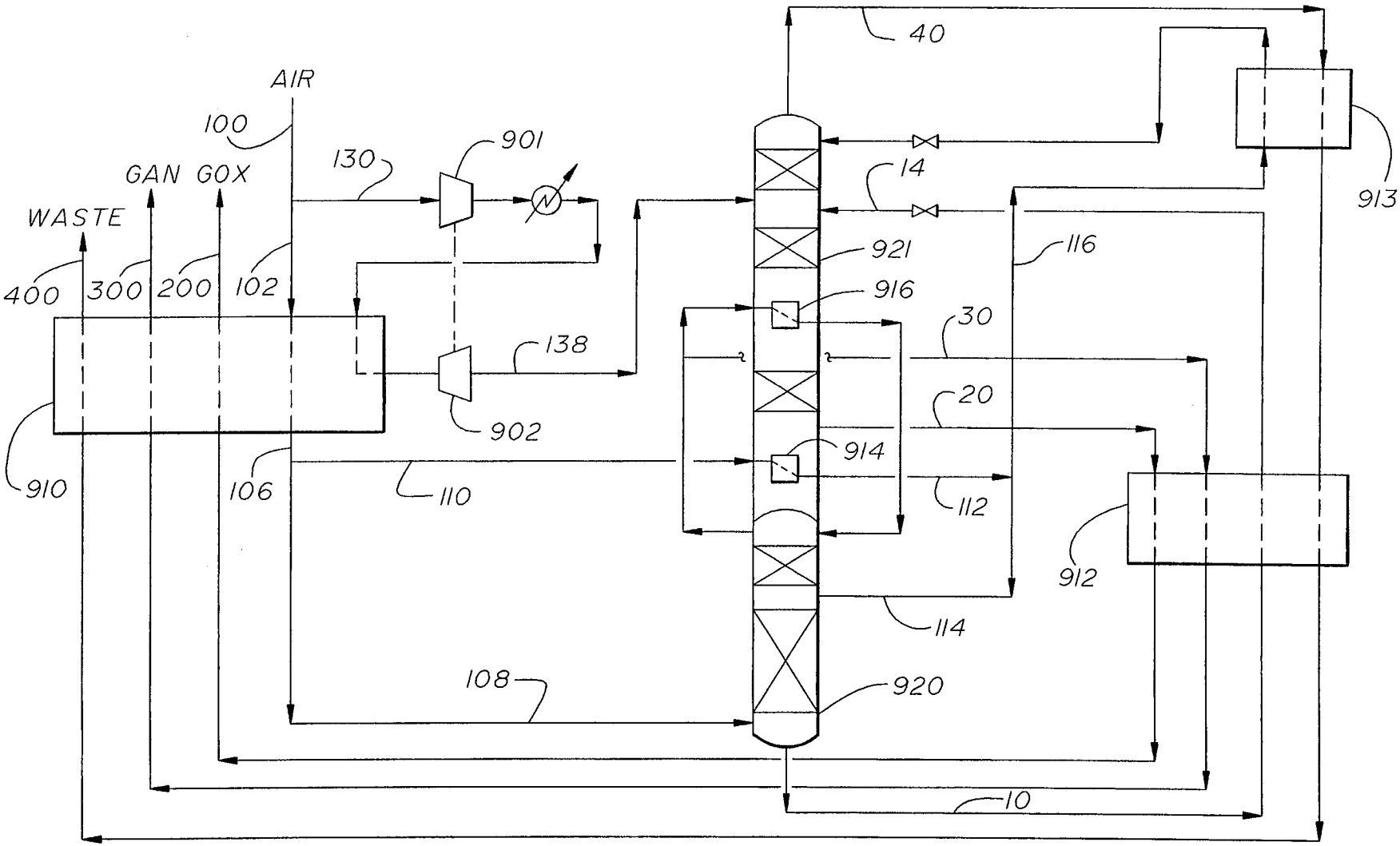

Such a concept can be used to produce lower purity oxygen as well. FIG. 3 shows how it is used in a dual reboiler air separation unit to produce lower purity oxygen and pressurized nitrogen. In this embodiment, the compressed, dry and contaminant-free air, line 100, is first split into two portions, line 102 and 130. The minor portion, line 130, is compressed in compressor 901, cooled in main heat exchanger 910 and expanded in expander 902. The expander effluent, line 138, is fed to an upper intermediate location of lower pressure column 921. In the present embodiment, compressor 901 and expander 902 are mechanically linked. The major portion, line 102, is cooled in main heat exchanger 910 to a temperature close to its dew point and split into two substreams. The first substream, line 108, is fed to the bottom of higher pressure column 920. The second substream, line 110, is condensed in boiler/condenser 914 located in the bottom of lower pressure column 921 against boiling liquid oxygen. The produced liquid air, line stream 112, is then split into two fractions, lines 114 and 116. The minor portion, stream 114, is fed to the middle of higher pressure column 920 as impure reflux. The major portion, stream 116, is subcooled in colder subcooler 913, flashed and fed to the top of lower pressure column 921 as liquid reflux.

The feed air to higher pressure column 920 is separated into a higher pressure nitrogen overhead and an oxygen-enriched bottoms liquid. A portion of the nitrogen overhead is condensed in boiler/condenser 916 and returned to the top of higher pressure column 920 as reflux. The remaining portion of the nitrogen overhead is removed, via line 30, warmed to recover refrigeration in heat exchangers 912 and 910, and then recovered as gaseous nitrogen product (GAN), line 300. The oxygen-enriched bottoms liquid from the higher pressure column, line 10, is subcooled in warmer subcooler 912, reduced in pressure and fed to lower pressure column 921, via line 14.

The feeds to the lower pressure column are distilled and separated into a vapor stream and a oxygen bottoms liquid. The vapor stream from the top of column 921, line 40, which contains less than 95% nitrogen, is warmed to recover refrigeration in exchangers 913, 912 and 910 and removed as waste nitrogen product, line 400. Gaseous oxygen removed from the bottom of column 921, line 20, is warmed in exchangers 912 and 910 to recover refrigeration and recovered as gaseous oxygen product (GOX), line 200.

Figure 4:
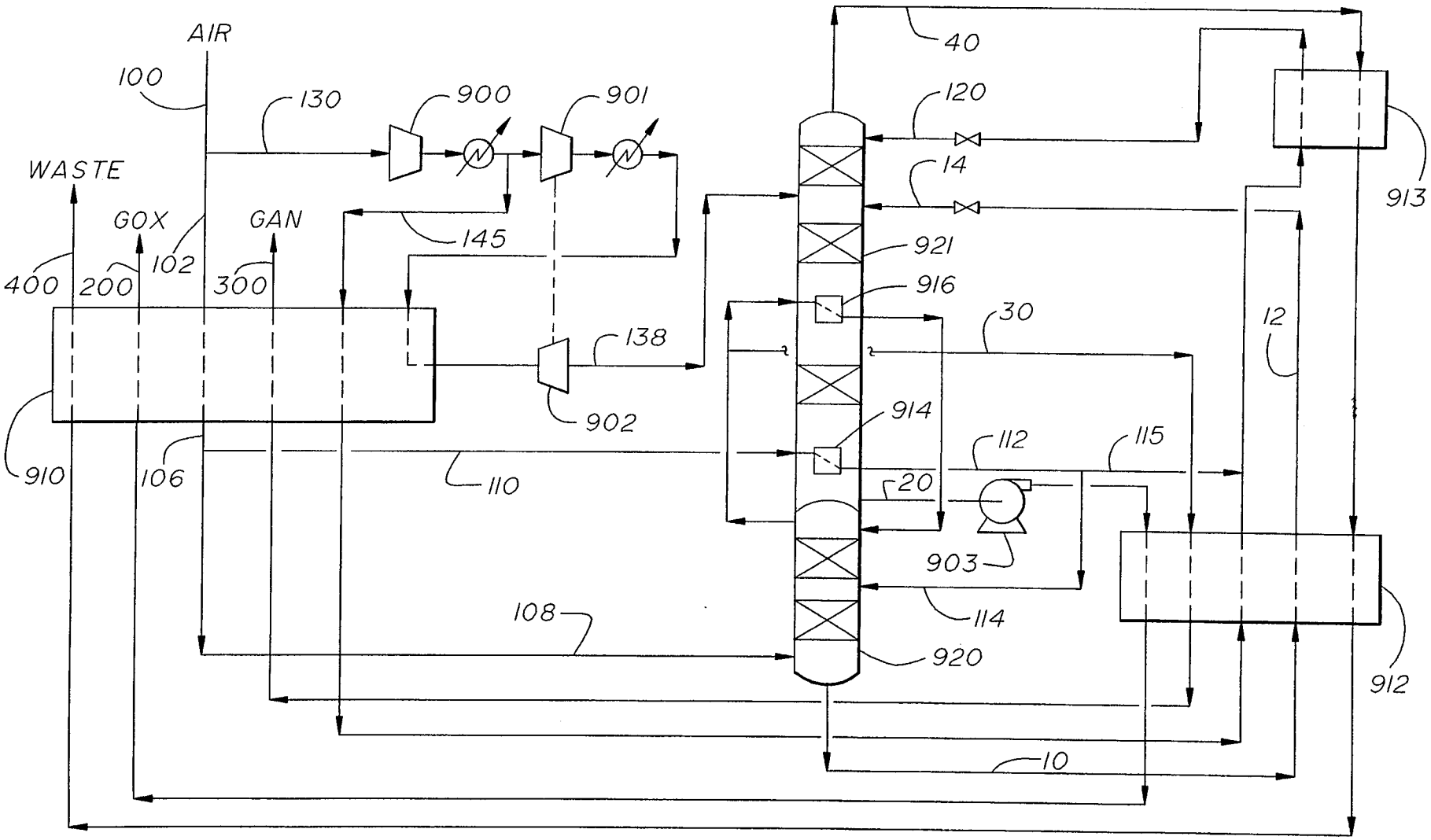

FIG. 4 depicts a pumped LOX embodiment of the embodiment shown in FIG. 3. In this embodiment, the minor portion, line 130, is first compressed in compressor 900 to a higher pressure and then separated into two parts. The first part, line 146, is cooled and condensed in main heat exchanger 910, subcooled in warmer subcooler 912 and combined with the liquid air from boiler/condenser 914, line 115. The combined liquid air is then further subcooled in colder subcooler 913 and reduced in pressure before being fed, via line 120, to lower pressure column 921 as reflux. Also, liquid oxygen, line 20, is pumped to an appropriate pressure with pump 903, heated to recover refrigeration, vaporized and recovered as gaseous oxygen product, line 200. Except for the above changes, the remainder of the embodiment shown in FIG. 4 is the same as that shown in FIG. 3.

Figure 5:
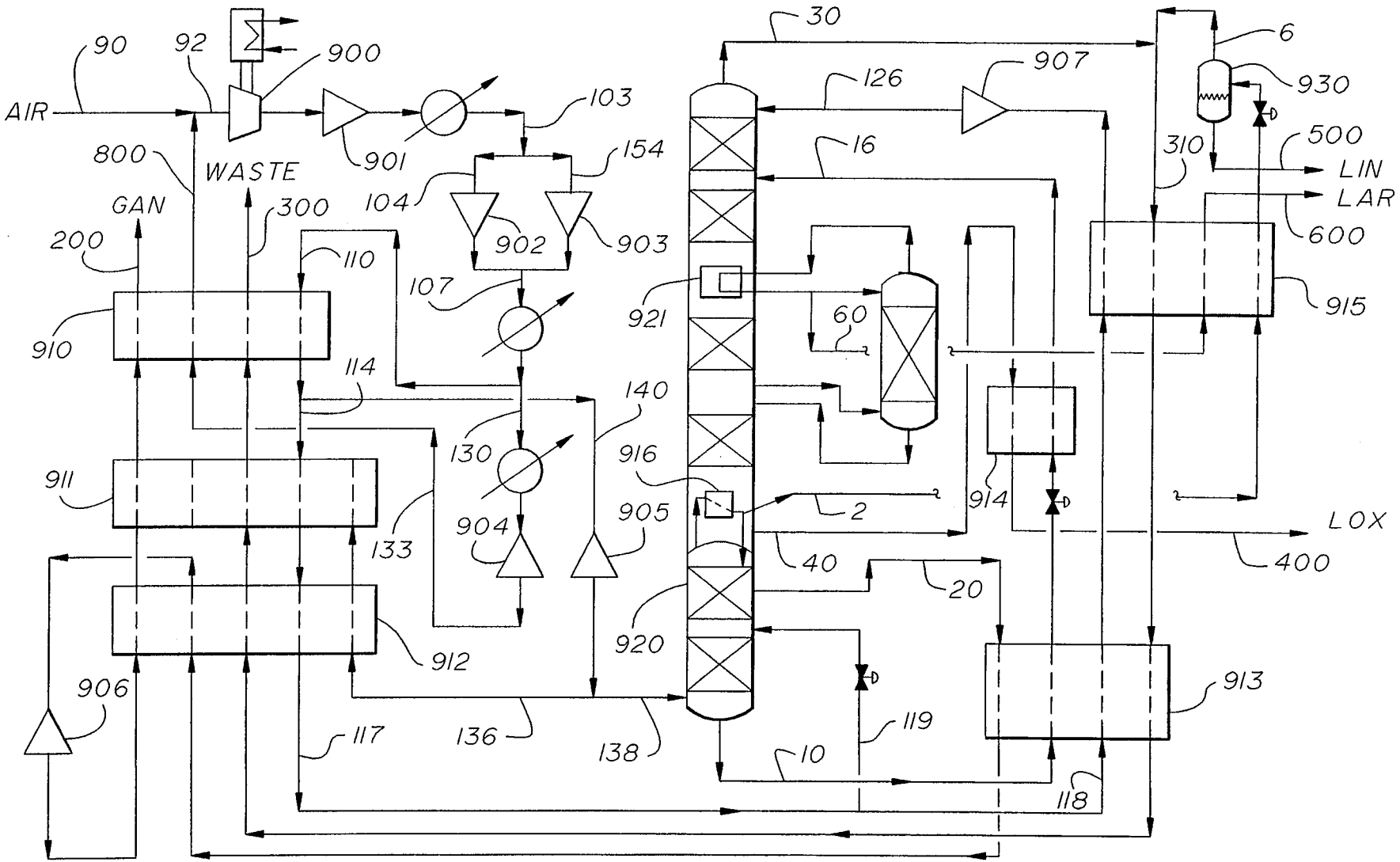
FIGS. 5 and 6 are schematic diagrams of the two embodiments of the process of the present invention with incorporated liquefier cycle.

FIG. 5 is an embodiment for producing substantial amount of liquid products (>10% of feed air). In this embodiment, compressed, dry and contaminant-free feed air, line 90, is combined with recycle air, line 800. This combined air stream, line 92, is further compressed by compressor 900 which is driven by an external power source, and then still further compressed by cornpander compressor 901. After being aftercooled, this high pressure air stream, line 103, is split into two portions, line 104 and 154, which are further compressed by cornpander compressors 902 and 903, respectively, to a pressure higher than the critical pressure of air. The effluent of compressors 902 and 903 are then combined and the combined stream, line 107, is cooled to a temperature close to ambient temperature. Once at near ambient temperature, the above critical pressure air stream is split into two portions, line 110 and 130. The first portion, line 110, is cooled in heat exchanger 910 and split into two substreams, lines 114 and 140. The second portion, line 130, is cooled, expanded in expander 904 and warmed to recover refrigeration in heat exchanger 910. This warmed, expanded second portion comprises the recycle stream, line 800. The first substream of the first portion, line 114, is further cooled in heat exchangers 911 and 912 to a temperature lower than the critical temperature of air. This dense fluid air below its critical temperature, line 117, is then separated into two pads, lines 118 and 119. The second substream, line 140, is expanded in expander 905 and split into two fractions, lines 136 and 138. The first part of the first substream, line 119, is reduced in pressure and fed to an intermediate location of higher pressure column 920 as impure reflux. The second part of the first substream, line 118 is subcooled in subcoolers 913 and 915, expanded in dense fluid expander 907 and then fed, via line 126, to the top of lower pressure column 921. The first fraction of the second substream, line 138, is fed to the bottom of higher pressure column 920 as feed. The second fraction of the second substream, line 136, is warmed in heat exchanger 912 and 911 to recover refrigeration and then combined with the effluent of expander 904, line 133.

The feed to higher pressure column 920 is separated therein and three streams are removed from higher pressure column 920. A liquid nitrogen stream, line 2, is removed, subcooled in colder subcooler 915, reduced in pressure and phase separated in phase separator 930. The vapor phase, line 6, exits phase separator 930 to be combined with the waste nitrogen, line 30, from lower pressure column 921. The liquid phase, line 500, exits phase separator 930 as liquid nitrogen (LIN) product. A nitrogen-rich vapor stream, line 20, is removed from higher pressure column 920 at the top or a few trays below the top of the column. This nitrogen-rich stream, line 20, is warmed in heat exchangers 913 and 912, expanded in expander 906, further warmed to ambient temperature in heat exchangers 911 and 910 and recovered as gaseous nitrogen (GAN) product, line 200. The oxygen-enriched bottoms liquid from higher pressure column, line 10, is subcooled in warmer subcooler 913, reduced in pressure, used for LOX subcooling in subcooler 914, and fed, via line 16, to lower pressure column 921.

The feeds to lower pressure column 921 are distilled therein and three streams are removed from lower pressure column 921. A waste nitrogen stream, line 30, which contains less than 95% nitrogen, is removed and combined with the vapor stream, line 6, from phase separator 930. The resultant vapor stream, line 310, is warmed to recover refrigeration exiting the process as waste, line 300, at near ambient temperature. Liquid oxygen, line 40, is removed, subcooled in subcooler 914 and recovered as liquid oxygen (LOX) product, line 400. Finally, a vapor stream which is argon enriched exits the lower pressure column at a section above the bottom and is fed to the bottom of the side column which distillates it into liquid argon rich stream, line 60, and the oxygen rich bottoms liquid, which is fed back to the lower pressure column at where the vapor feed to the side column comes from. The side column condenser is integrated with the lower pressure column such that the argon vapor from the top of the side column condenses against partial vaporization of the liquid a few trays below where the oxygen rich bottoms liquid from the higher pressure column, line 16, is fed to the lower pressure column. The argon rich liquid stream, line 60, is then subcooled in the subcooler before exiting the system.

Figure 6:
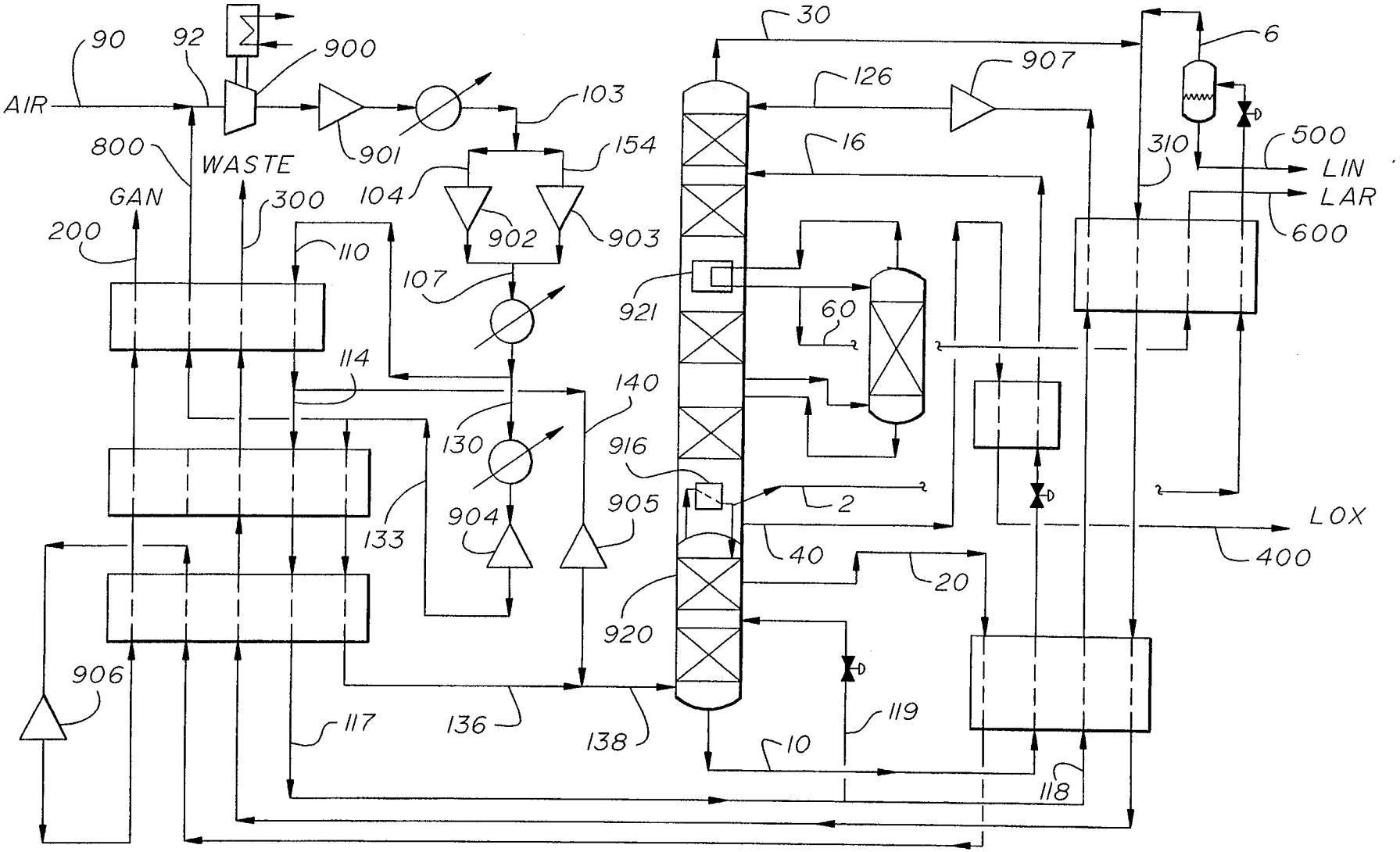

The embodiment in FIG. 5 shows the case when liquid production is more than 20% of the feed air. When the liquid make is less, some of the recycle streams (lines 136 and 800) can be reversed, and the liquid air feed to the higher pressure column, line 119, can be eliminated as is shown in the embodiment of FIG. 6.

Figure 7:
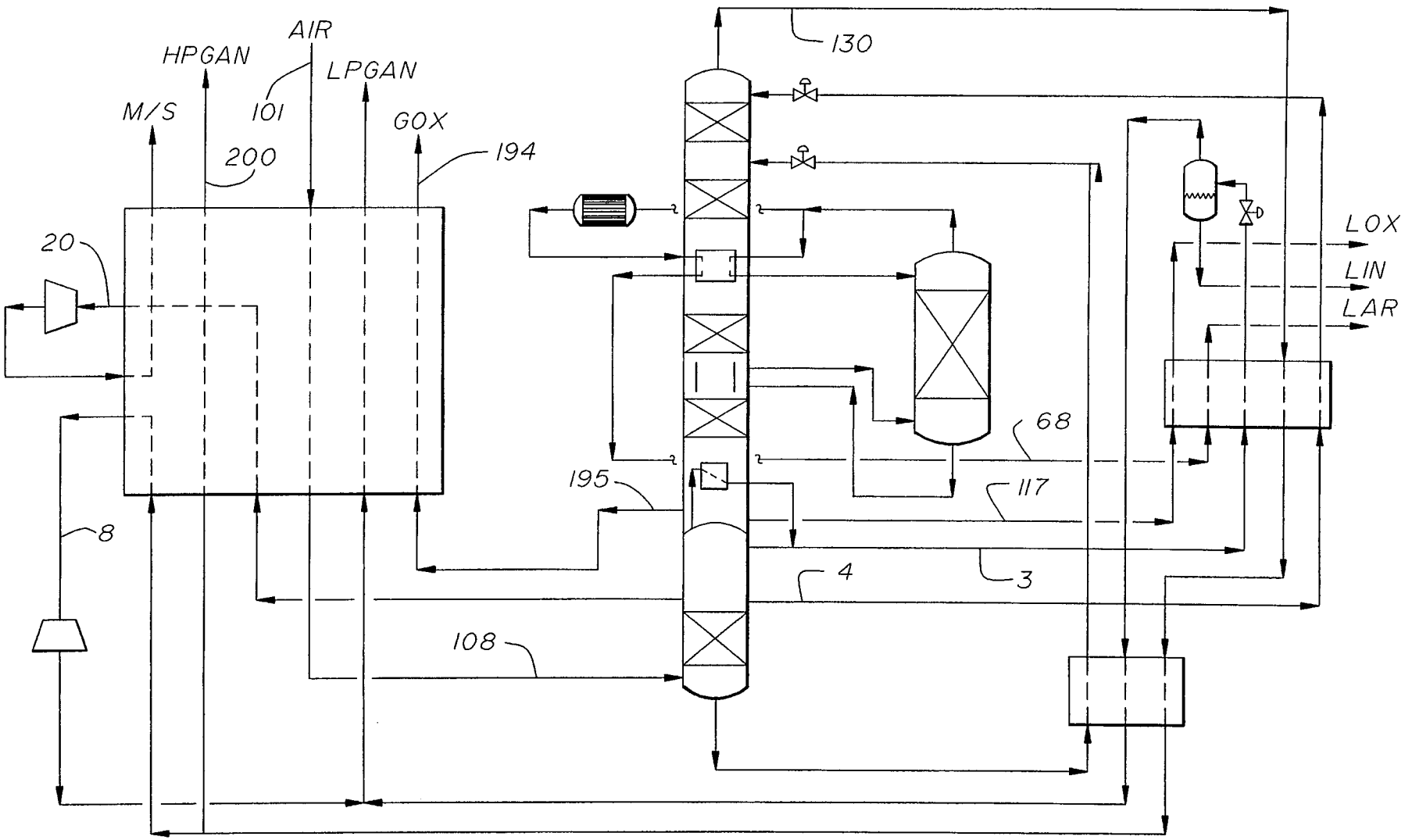
FIG. 7 (PRIOR ART)
FIG. 7 is a schematic diagram of the process of the prior art as taught in U.S. Pat. No. 5,165,245.

The present invention, by producing a stream of liquid air and feeding it to a distillation column as an impure reflux stream, and by removing a substantial amount of vapor from one of the columns at or within four trays above the tray where the liquid air is fed to the column so that this vapor stream has a nitrogen mole fraction of less than 95% results in significant reduction in the amount of oxygen from this waste stream. The process of this invention differs from the conventional ways of designing and operating an oxygen separation plant in which oxygen recovery is to be maximized. These process of the present invention has the following advantages over the conventional process, which is depicted in FIG. 7.

(1) Since the minimum work of separation for each mole of oxygen is smaller at lower recoveries than at higher recoveries, the present invention has an energy benefit. For example, the minimum work of separation for each mole of oxygen is 8.35% less in a process where 85.9% of the oxygen in the feed air recovered as oxygen product (a process according to the present invention) than in a conventional process with complete oxygen recovery.

(2) The present invention saves compression machinery when a substantial amount (between 15% and 30% of feed air) of nitrogen is required as pressurized product (delivery pressures from slightly below the pressure of the higher pressure column and above) or when substantial amount of the feed air exits (>10%) as liquid product.

EXAMPLES

In order to demonstrate the efficacy of the present invention and to provide a comparison to the conventional process, the following examples were computer simulated. The results of these simulations illustrate the above points. The following example are based on the following production demands:

| Product | Purity: vol % | Pressure: psia | Flow Ratio* |
|---|---|---|---|
| Oxygen | >99.5 | 178 | 1.0 |
| Nitrogen | >99.99 | 81 | 1.46 |
| Crude Liquid Argon | >99.5 | | as much as possible |
| Liquid Nitrogen | >99.99 | | 0.023 |
| Liquid Oxygen | >99.5 | | 0.032 |

*Flow Ratio is defined as: Mole Flow/Oxygen Mole Flow

The cycles used for the simulation are FIG. 1 and FIG. 7. The former is an embodiment of the process of the present invention. The latter is a process with essentially complete recovery as is disclosed in U.S. Pat. No. 5,165,245. The results of simulation are shown in following Tables 1 through 4.

From Table 1, it can be seen that one can save the nitrogen compressor, replacing the oxygen compressor by an air booster, and two generator loaded expanders with a compander. The number of trays are also reduced, so that the cold box can be shorter. The data shown in Table 2 indicates that the molecular sieve bed for the scheme of FIG. 1 will be almost 17% larger. The argon recovery is smaller, yet, the absolute amount of argon produced is not significantly reduced. The argon recovery of the present invention is equivalent to 80% argon recovery for the conventional process with complete oxygen recovery. In terms of energy, the process of FIG. 1 is 2.1% lower. If only the energy needed for gas separation is used, this is power saving of 4%, a significant number.

It should be mentioned here that in the simulation condition for the process depicted in FIG. 1, the reflux ratio in the higher pressure column is high meaning that less trays are needed for a fixed nitrogen purity. Therefore, it is possible to take out more nitrogen and increase the number of trays in the higher pressure column. Thus, the power can be further improved. However, the argon recovery will be further reduced, and oxygen purity (or recovery) will also decrease.

It should be noted that the process depicted in FIG. 7 when operating at elevated pressures is the best prior art known for the coproduction of oxygen and nitrogen. Since elevated pressure cycles are about 8% more efficient than the conventional lower pressure cycle in terms of separation power. The cumulative power advantage of the present invention over the conventional low pressure cycle 12%. It is important to note that an elevated pressure cycle needs to produce some amount of liquid product to be power efficient, if all the nitrogen is not required as a pressurized product. However, the process of the present invention works without liquid production too. In such circumstances, the only comparable cycle is the conventional low pressure cycle, and the present invention is 12% better in power (in terms of energy needed for separation) than the conventional low pressure cycle.

Some of the stream parameters for simulation are shown in Table 3 and 4. The basis of the simulation is 100 Ibmol/hr of feed air.

TABLE 1

| | Equipment Comparison | | | | | | |
|---|---|---|---|---|---|---|---|
| | Number of Trays | | | | | | |
| Embodiment | HP Column | LP Column | Compander | Expander | Nitrogen Compressor | Air Booster | Oxygen Compressor |
| FIG. 1 | 25 | 80 | 1 | 0 | 0 | 1 | 0 |
| FIG. 7 | 40 | 93 | 0 | 2 | 1 | 0 | 1 |

TABLE 2

| | Recovery and Power Comparision | | |
|---|---|---|---|
| Embodiment | Oxygen Recovery: % of Air | Argon Recovery: % of Ar in Air | Relative Power |
| FIG. 1 | 17.93 | 68.0 | 0.979* |
| FIG. 7 | 20.95 | 84.5 | 1.0 |

TABLE 3

| | Stream Parameters for the FIG. 1 Embodiment | | | | | | | | | | | | |
|---|---|---|---|---|---|---|---|---|---|---|---|---|---|
| | Stream Number | | | | | | | | | | | | |
| | 100 | 106 | 126 | 140 | 30 | 200 | 50 | 40 | 144 | 300 | 400 | 700 | 60 |
| Temperature: °F. | 55 | −272 | 55 | −130 | −287.3 | 49.8 | −288.7 | −313.9 | −287.3 | 49.8 | 49.8 | −316.8 | −297.5 |
| Pressure: psia | 86.5 | 84.5 | 400 | 684 | 82.8 | 178 | 23.6 | 18.5 | 71 | 81 | 16.1 | 18.5 | 19.5 |
| Flow: lbmol/hr | 100 | 66 | 24.8 | 9.2 | 26 | 17.4 | 0.6 | 54.9 | 9.2 | 26 | 55 | 0.4 | 0.6 |

TABLE 4

Stream Parameters for the FIG. 7 Embodiment

| | Stream Number | | | | | | | | | | | |
|---|---|---|---|---|---|---|---|---|---|---|---|---|
| | 101 | 108 | 3 | 4 | 130 | 195 | 117 | 68 | 200 | 194 | 20 | 8 |
| Temperature: °F. | 55 | −266 | −278.5 | −278.5 | −308.4 | −279.7 | −279.7 | −288.5 | 50.5 | 50.5 | −120.2 | −249.2 |
| Pressure: psia | 122.8 | 120.6 | 117.8 | 118.0 | 30.1 | 10<br>36.9 | 36.9 | 31.3 | 28.3 | 34.7 | 117.7 | 20.9 |
| Flow: lbmol/hr | 100 | 100 | 0.5 | 36.5 | 71.4 | 20.3 | 0.7 | 0.8 | 30.5 | 20.3 | 6.3 | 40.9 |

The present invention has been described with reference to several specific embodiments thereof. These embodiments should not be seen as a restriction of the scope of the present invention. The scope hereof should be ascertained by reference to the following claims.

I claim:

1. A cryogenic distillation process for the separation of compressed, dry and contaminant-free air into its constituent components utilizing a distillation column system having at least two distillation columns operating at different pressures, wherein the top of the higher pressure column is in thermal communication with the lower pressure column, wherein a nitrogen product is produced at the top of the higher pressure column and an oxygen product is produced at the bottom of the lower pressure column, characterized in that: (a) a portion of the compressed, dry and contaminant-free feed air is condensed thereby producing a liquid air stream; (b) feeding at least a portion of the liquid air stream as impure reflux to at least one distillation column of the distillation column system, and (c) removing a waste vapor stream having a nitrogen mole fraction of less than 0.95 from a location in the distillation column system situated not more than four theoretical stages above the location in the column where the liquid air stream of step (b) is fed to the distillation column system.

2. The process of claim 1 wherein the liquid air stream portion of step (b) is fed to the top of the lower pressure column and the waste vapor stream of step (c) is removed from the top of the lower pressure column.

3. The process of claim 2 wherein another portion of the liquid air of step (a) is fed to an intermediate location of the higher pressure column.

4. The process of claim 3 wherein another waste vapor stream is removed from a location of the high pressure column not more than four theoretical stages above the location in the column where the another portion of liquid air is fed to the higher distillation column.

5. The process of claim 1 wherein the portion of feed air of step (a) is condensed by heat exchange with warming process stream leaving the process.

6. The process of claim 1 wherein the portion of feed air of step (a) is condensed by heat exchange with boiling liquid oxygen in the bottom the lower pressure column.

7. The process of claim 1 wherein the portion of feed air of step (a) is condensed by heat exchange with warming process stream leaving the process and by heat exchange with boiling liquid oxygen in the bottom the lower pressure column.

* * * * *